US006234138B1

(12) United States Patent
Cathey

(10) Patent No.: US 6,234,138 B1
(45) Date of Patent: May 22, 2001

(54) COMBINATION POWER COLLECTOR FOR INTERNAL COMBUSTION ENGINE

(76) Inventor: Elbert E. Cathey, 1001 Lovers Leap Rd., Kingston Springs, TN (US) 37082

( * ) Notice: Subject to any disclaimer, the term of this patent is extended or adjusted under 35 U.S.C. 154(b) by 0 days.

(21) Appl. No.: 09/301,991

(22) Filed: Apr. 29, 1999

(51) Int. Cl.[7] ..... F02B 75/32
(52) U.S. Cl. ..... 123/197.4; 123/78 E; 123/78 F
(58) Field of Search ..... 123/48 B, 78 E, 123/78 F, 197.1, 197.3, 197.4

(56) References Cited

U.S. PATENT DOCUMENTS 4,934,344 * 6/1990 Perr ..... 123/78 F
4,938,186 * 7/1990 Pal et al. ..... 123/197.1
5,448,970 * 9/1995 Bray ..... 123/53.1
5,465,648 * 11/1995 Cy ..... 92/140
5,535,715 * 7/1996 Mouton ..... 123/197.1
5,644,917 * 7/1997 McWaters ..... 60/517
6,009,845 * 1/2000 Ehrlich ..... 123/197.4

* cited by examiner

*Primary Examiner*—Noah P. Kamen
*Assistant Examiner*—Hai Huynh
(74) *Attorney, Agent, or Firm*—Waddey & Patterson; Lucian Wayne Beavers

(57) ABSTRACT

An internal combustion engine includes a power shaft driven by at least one piston and cylinder assembly. A power transfer mechanism connects the piston to the power shaft so that for each two reciprocating cycles of the piston within the cylinder, the power shaft makes only one 360° rotation.

20 Claims, 6 Drawing Sheets

COMBINATION POWER COLLECTOR FOR INTERNAL COMBUSTION ENGINE

BACKGROUND OF THE INVENTION

1. Field of the Invention

The present invention relates generally to internal combustion engines, and more particularly, but not by way of limitation, to an internal combustion engine which operates on a four stroke power cycle while only rotating its power shaft one revolution as each piston goes through the four stroke power cycle.

2. Description of the Prior Art

Internal combustion engines developed in the 1800's basically are unchanged today. Existing four stroke internal combustion engines have their pistons attached to their power shaft or crank shaft in such a way that the power shaft makes two revolutions as each piston moves through the four stroke cycle.

There is a need in the prior art for improved internal combustion engine designs which are more efficient, provide longer engine life, and provide increased torque at lower operating RPM.

SUMMARY OF THE INVENTION

The present invention provides an internal combustion engine design which has a power shaft and which has at least one piston and cylinder assembly providing power to the power shaft. The engine includes a power transfer mechanism connecting the piston to the power shaft so that for each two reciprocating cycles of the piston within the cylinder, the power shaft makes only one 360° revolution or rotation.

In one embodiment, the internal combustion engine has a power shaft, a power crank, and a ratchet connecting the power crank to the power shaft. A piston is connected to the power crank by a connecting rod. An auxiliary crank shaft is provided. A two-to-one drive train connects the auxiliary crank shaft to the power shaft so that the auxiliary crank shaft rotates at twice the rotational speed of the power shaft. An auxiliary connecting rod connects the auxiliary crank shaft to the power crank so that the power crank is moved through one reciprocating cycle for each rotation of the auxiliary crank shaft.

It is therefore an object of the present invention to provide an improved internal combustion engine design.

Another object of the present invention is the provision of an internal combustion engine design which eliminates the traditional cam shaft, by combining the cam shaft and power shaft. Still another object of the present invention is the provision of an internal combustion engine design which provides longer engine life.

Yet another object of the present invention is the provision of an internal combustion engine design which results in less scoring on pistons and sleeves.

Still another object of the present invention is the provision of an internal combustion engine design which provides higher torque at lower RPM as compared to traditional engines.

Yet another object of the present invention is the provision of an internal combustion engine design having less weight in the power transmission parts between the piston and a flywheel.

Still another object of the present invention is to provide an internal combustion engine design which is economical to manufacture.

And another object of the present invention is the provision of an internal combustion engine design which is safer to operate.

These and other objects, features and advantages of the present invention will be readily apparent of those skilled in the art upon reading of the following disclosure when taken in conjunction with the accompanying drawings.

DETAILED DESCRIPTION OF THE PREFERRED EMBODIMENTS

Figure 1:
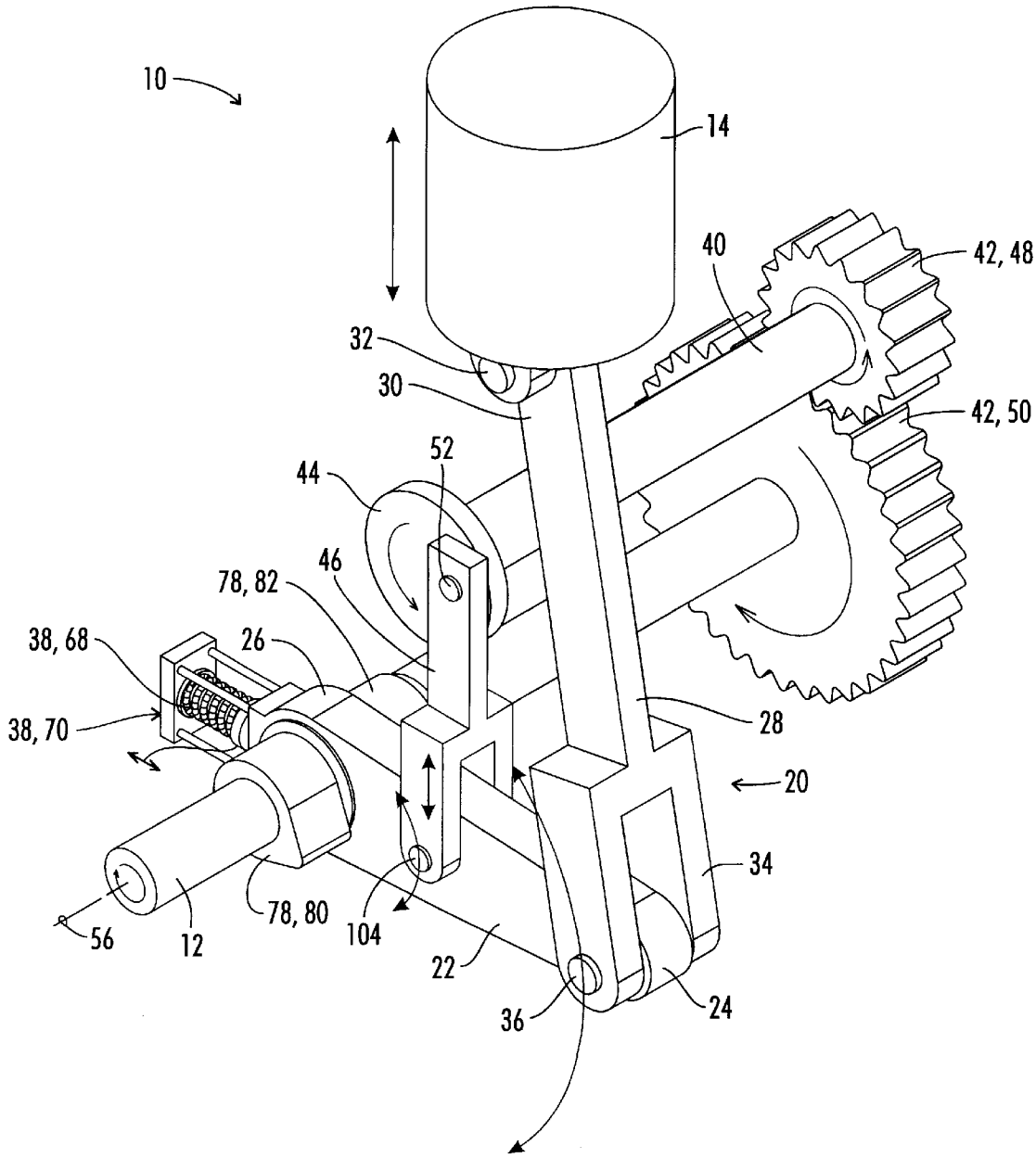
FIG. 1 is a perspective view of the internal components of the internal combustion engine of the present invention.
Figure 2:
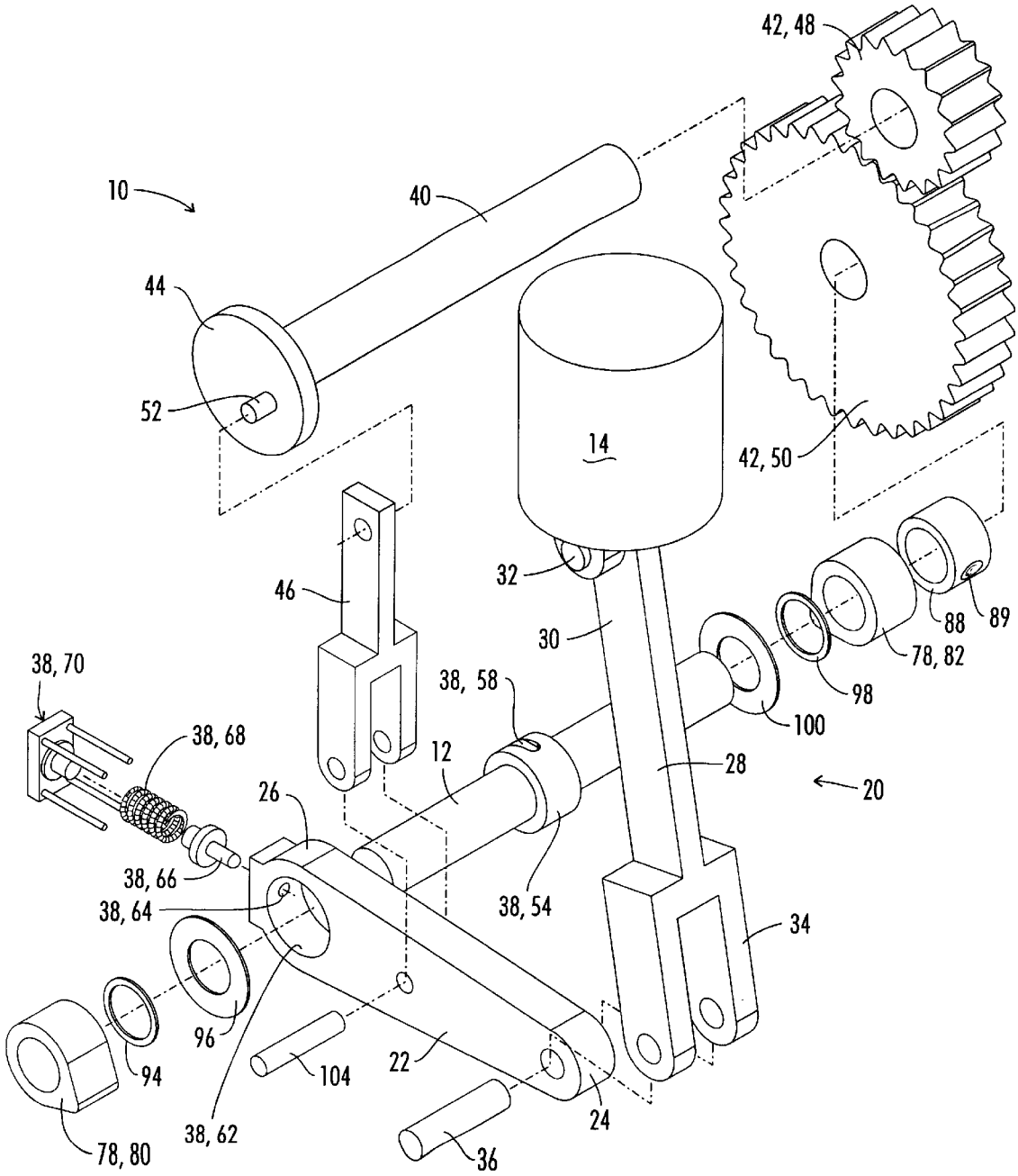
FIG. 2 is an exploded view of the components shown in FIG. 1.

Refer now to the drawings, and particularly to FIGS. 1 and 2, the internal combustion engine of the present invention is shown and generally designated by the numeral 10. It will be appreciated that FIGS. 1 and 2 are schematic illustrations only showing the critical internal components of the engine. It will be understood by those skilled in the art that these components are contained within a generally conventional engine block.

Figure 15:
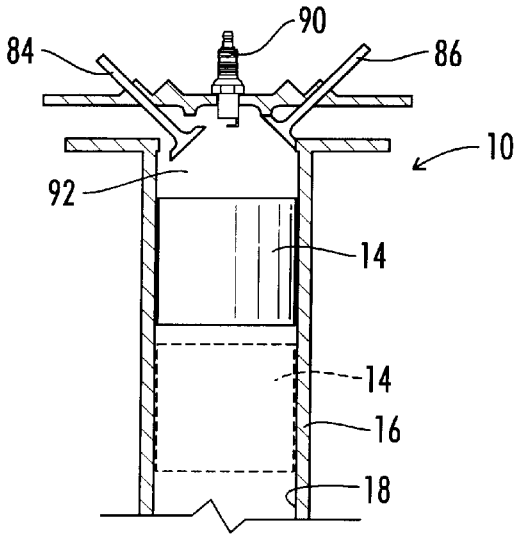
FIG. 15 is a schematic sectioned elevation view of the piston within a cylinder and showing the combustion chamber, intake and exhaust valves, and spark plug.

The engine 10 includes a power shaft 12 which is driven by one or more pistons 14. As schematically illustrated in FIG. 15, the piston 14 is part of a piston and cylinder assembly comprising the piston 14 and a cylinder 16 having a cylinder bore 18 within which the piston 14 reciprocates between an uppermost or top dead center position as shown in solid lines in FIG. 15, and a lowermost or bottom dead center position as shown in dash lines in FIG. 15. It is noted that due to the difference in construction of the engine 10 as compared to conventional engines, the terms top dead center and bottom dead center do not mean that there is alignment of the piston rod with a crank throw; here those terms refer to the uppermost and lowermost positions of the piston 14 within the cylinder 16.

A power transfer mechanism 20 connects the piston 14 to the power shaft 12 so that for each two reciprocating cycles of the piston 14 within the cylinder 16, the power shaft 12 makes only one 360° rotation.

The piston 14 and cylinder 16 are constructed to perform a four stroke combustion cycle, so that two reciprocations of the piston 14 within the cylinder 16 include a downward intake stroke, an upward compression stroke, a downward power stroke, and an upward exhaust stroke.

The power transfer mechanism 20 includes a power crank 22 having an outer end portion 24 and an inner end portion 26. Power transfer mechanism 20 further includes a piston connecting rod 28 having an upper or first end 30 connected to piston 14 by a connecting pin 32, and having a second or lower end 34 connected to the outer end 24 of power crank 22 by a second connecting pin 36.

The power transfer mechanism 20 further includes a ratchet 38 connecting the inner end portion 26 of power crank 22 to the power shaft 12.

The power transfer mechanism 20 further includes an auxiliary crank shaft 40, a two-to-one ratio drive train 42, an eccentric crank 44, and an auxiliary connecting rod 46.

The two to one ratio drive train 42 includes first and second gears 48 and 50, the second gear 50 having twice the number of teeth of first gear 48, with the gears connecting the auxiliary crank shaft 40 to the power shaft 12 so that the auxiliary crank shaft 40 rotates at twice the rotational speed of the power shaft 12.

The eccentric crank 44 is attached to the auxiliary crank shaft 40. The auxiliary connecting rod 46 has its first or upper end connected to the eccentric crank 44 at eccentric crank pin 52, and has its lower or second end attached to the power crank 22 by a pin 54 located midway along the length of power crank 22. Thus, each time the piston 14 moves through one up and down reciprocation, the auxiliary connecting rod 46 drives the crank 44 and auxiliary crank shaft 40 through one revolution.

Thus, once the engine 10 is placed in motion and the power shaft 12 is smoothly rotating due to the power impulses imparted thereto by piston 14 and by the momentum of a conventional flywheel (not shown), as the power shaft 12 moves through a single rotation, the two to one gear train 42 will cause the auxiliary crank shaft 40 to move through two revolutions, and the eccentric crank 44 and auxiliary connecting rod 46 will cause the crank arm 42 to move through two reciprocations, that is an up, a down, another up and another down motion, for each revolution of the power shaft 12.

The details of construction of the ratchet 38 are best seen in the exploded view of FIG. 2.

The ratchet 38 includes a cylindrical outer surface 54 defined on the power shaft 12 concentric about an axis of rotation 56 of the power shaft 12. The cylindrical outer surface 54 has two locking recesses 58 and 60 defined therein on diametrically opposite sides of the cylindrical outer surface 54. The two recesses 58 and 60 can best be seen in the sectioned view such as that of FIG. 4.

The power crank 22 has a cylindrical bore 62 defined therethrough within which the cylindrical outer surface 54 of power shaft 12 is received.

The power crank 22 has a locking pin bore 64 defined transversally therethrough and communicated with the cylindrical bore 62.

A locking pin 66 is reciprocally received in the locking pin bore 64.

A locking spring 68 biases the locking pin 66 inward toward the locking recesses 58 and 60 of the cylindrical outer surface 54 of the power shaft 12.

A ratchet frame 70 supports the locking spring 68 and locking pin 66 on the inner end portion 26 of power crank 22.

Figure 3:
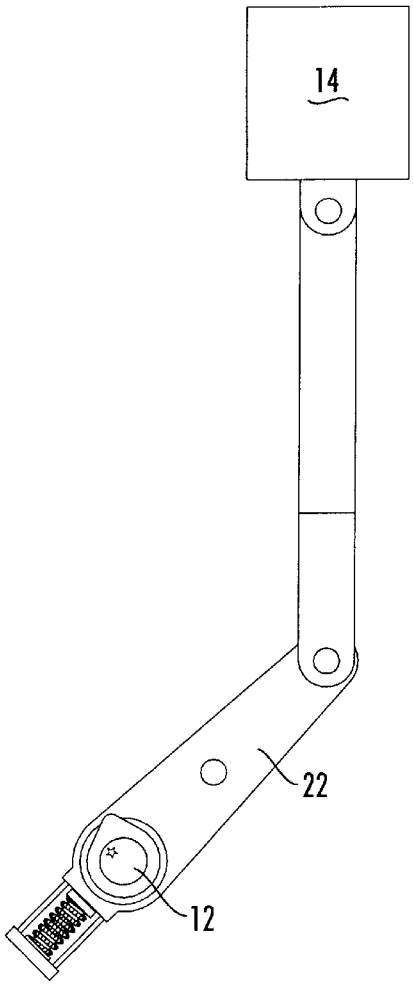
FIG. 3 is a schematic illustration of the piston, piston connecting rod, power crank, ratchet mechanism, and power shaft with the piston in the top dead center position immediately prior to beginning its intake stroke.
Figure 4:
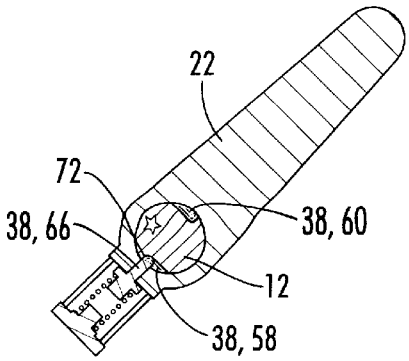
FIG. 4 is a sectioned illustration of the power crank, power shaft and ratchet mechanism corresponding to the position of FIG. 3 and showing the engagement of the spring biased pin with the locking recess defined in the power shaft.

As is best seen in FIG. 4, each of the locking recesses 58 and 60 is shaped so that when the locking pin 66 is engaged within the locking recess, a power stroke of the piston 14 and power crank 22 can be transferred to the power shaft 12 through the locking pin 66, and so that the power shaft 12 can then continue to rotate freely within the power crank 22 after the power stroke. This is shown, for example, by the sequential series of FIGS. 4, 6, 8 and 10. In FIG. 4, the locking pin 66 is abutted against a substantially radial abutment surface 72 which stops relative rotation of the power crank 22 in a clockwise direction relative to power shaft 12. Thus, the power crank 22 and power shaft 12 will rotate together through 90° about the axis 56 of power shaft 12 as the piston 14 moves between a top dead center position and a bottom dead center position, such as the movement from FIG. 3 to FIG. 5, or from FIG. 4 to FIG. 6.

Figure 5:
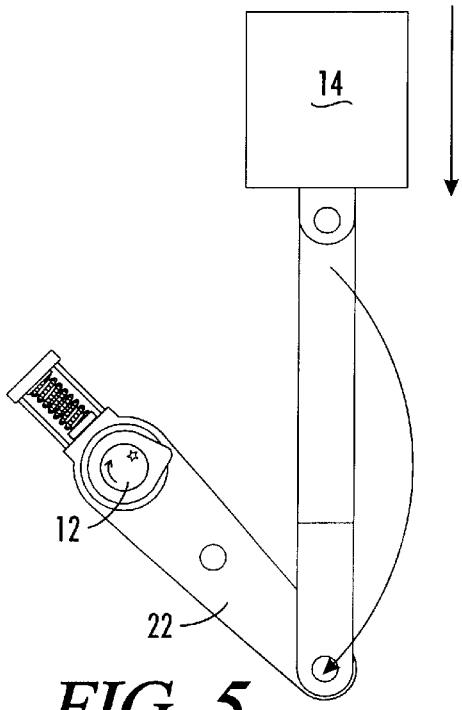
FIG. 5 is a view similar to FIG. 3 showing the piston having moved through its intake stroke to the bottom dead center position.
Figure 6:
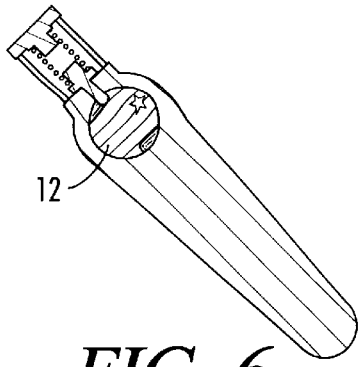
FIG. 6 is a sectioned view of the power crank, power shaft and ratchet mechanism corresponding to the position of FIG. 5.
Figure 8:
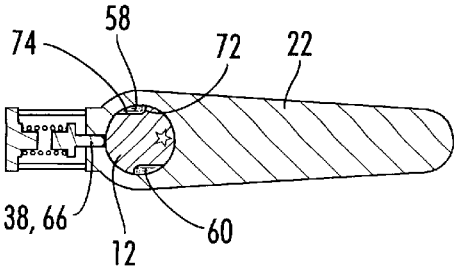
FIG. 8 is a sectioned view of the power shaft, power crank and ratchet mechanism corresponding to the position of FIG. 7.

When the piston 14 reaches its bottom dead position as seen in FIGS. 5 and 6, it will start to be pulled back upward by the action of auxiliary crank shaft 40 and auxiliary connecting rod 46, while the power shaft 12 will continue to rotate clockwise from the position of FIG. 6 to that of FIG. 8. This clockwise rotation of the power shaft 12 relative to the power crank 22 is permitted by the fact that the locking recess 58 includes a sloped portion 74 (see FIG. 8) which will cam the locking pin 66 radially outward so that it rides up on the outer cylindrical surface 54.

Figure 10:
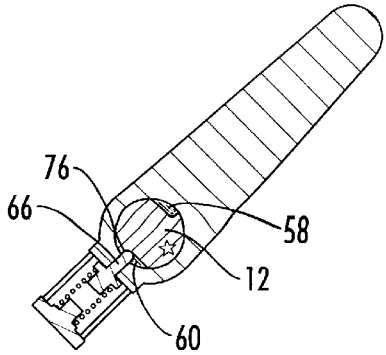
FIG. 10 is a sectioned view of the power shaft, power crank and ratchet mechanism corresponding to the position of FIG. 9.
Figure 11:
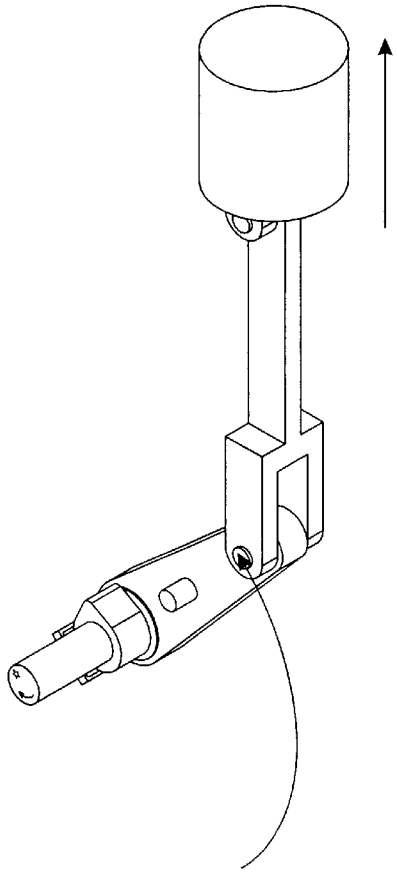
FIG. 11 is a perspective view of the piston, piston connecting rod, power crank, and power shaft in the top dead center position corresponding to FIG. 3.
Figure 12:
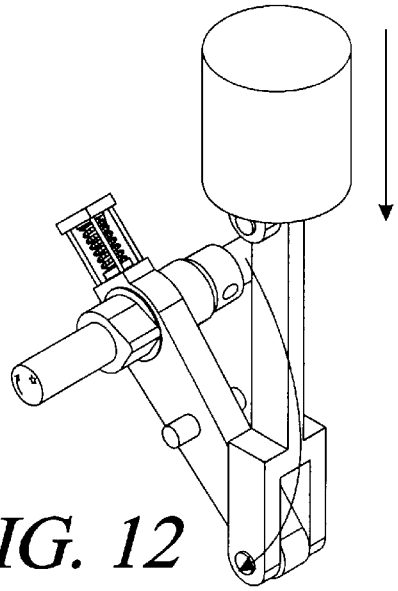
FIG. 12 is a view similar to FIG. 11 showing the piston in its bottom dead center position corresponding to FIG. 5.
Figure 13:
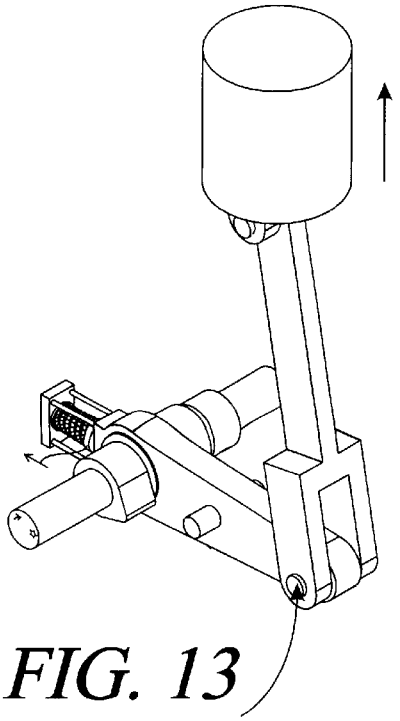
FIG. 13 is a view similar to FIG. 11 showing the piston having moved midway back upward through its exhaust stroke, corresponding to the position of FIG. 7.
Figure 14:
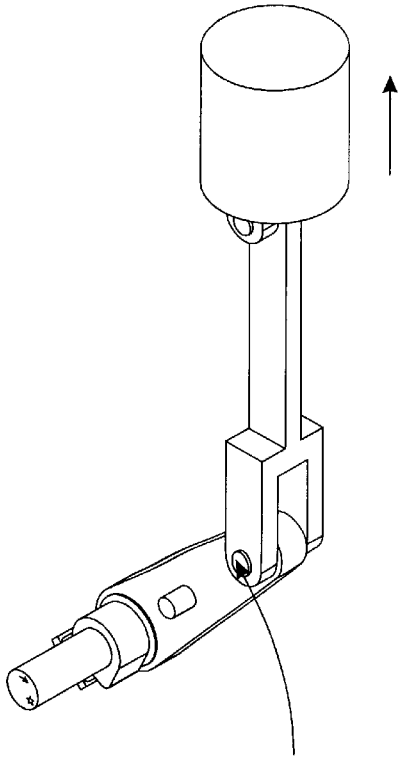
FIG. 14 is a view similar to FIG. 11 showing the piston having returned to a top dead center position at the end of its compression stroke, corresponding to FIG. 9.

Then, as the power crank 22 continues to move back upward or counter-clockwise, and as the power shaft 12 continues to rotate clockwise to the position of FIG. 10, the locking pin 66 will then engage the locking recess 60 and on the next downward power stroke of piston 14, the engagement of locking pin 66 with the abutment surface 76 of locking recess 60 will apply power to the power shaft 12 and cause the power shaft 12 to rotate with the downward power stroke of piston 14.

Thus, for each of the locking recesses such as locking recess 58 the recess can be described as including a sloped portion 74 which allows relative rotation between the power shaft 12 and power crank 22 in a first direction, and including an abutment surface 72 which stops relative rotation between the power shaft 12 and the power crank 22 in a second direction opposite the first direction.

The locking recesses 58 and 60 may also be referred to as power shaft locking surfaces concentrically defined upon the power shaft 12.

During the downward power stroke of piston 14, a portion of the power transmitted to power shaft 12 will be transmitted through auxiliary connecting rod 46, eccentric crank 44, auxiliary crank shaft 40, and gears 48 and 50.

The engine 10 includes cam means 78 which in turn includes an intake cam 80 and an exhaust cam 82 mounted upon the power shaft 12. The intake cam 80 and exhaust cam 82 actuate intake and exhaust valves 84 and 86 (see FIG. 15) through conventional valve drive trains including tappet rods, rockers, return springs and the like (not shown). In the illustrated embodiment the cams 80 and 82 are separately mounted upon and attached to the power shaft 12 with attachment means such as set screws (not shown) or the like. This allows the position of the cams upon the power shaft to be adjusted thus adjusting the intake and exhaust valve duration.

A spacer ring 94 and thrust washer 96 are located between the cam 80 and the power crank 22.

A spacer ring 98 and thrust washer 100 are located between the cam 82 and the enlarged diameter portion of power shaft 12 upon which the outer cylindrical surface 54 is defined.

An ignition timing ring 88, which may also be referred to as a slip depression ring 88, is adjustably mounted on the power shaft 12 in a manner similar to the cams 80 and 82. The ignition ring 88 in combination with an ignition coil (not shown) will provide at the appropriate timing a spark to spark plug 90 in a conventional manner to cause combustion of gases within the combustion chamber 92 of the cylinder 16. The ignition timing ring 88 includes an indentation 89 to signal the ignition coil at the proper time to ignite the air fuel mixture in the combustion chamber 92.

The power crank 22 may also be referred to as a floating power shaft throw 22.

The ratchet 38 may also be referred to a spring biased lock pin assembly 38 or a floating lock 38. The spring biased lock pin assembly 38 is attached to the power shaft throw 22, and operably associated with the power shaft locking surfaces 58 and 60, so that the lock pin assembly 38 alternately locks and unlocks from the power shaft locking surfaces 58 and 60 to convert a reciprocating arcuate motion of the power shaft throw 22 into a rotational motion of the power shaft 12.

DESCRIPTION OF OPERATION OF THE ENGINE

A detailed description will now be provided of the motion of the components of the engine as the piston 14 moves through its entire four stroke cycle including a downward intake stroke, an upward compression stroke, a downward power stroke and an upward exhaust stroke.

The description will begin the relevant components in the position illustrated in FIGS. 3 and 4 which correspond to a top dead center position of the piston 14 at the beginning of the intake stroke.

Figure 16:
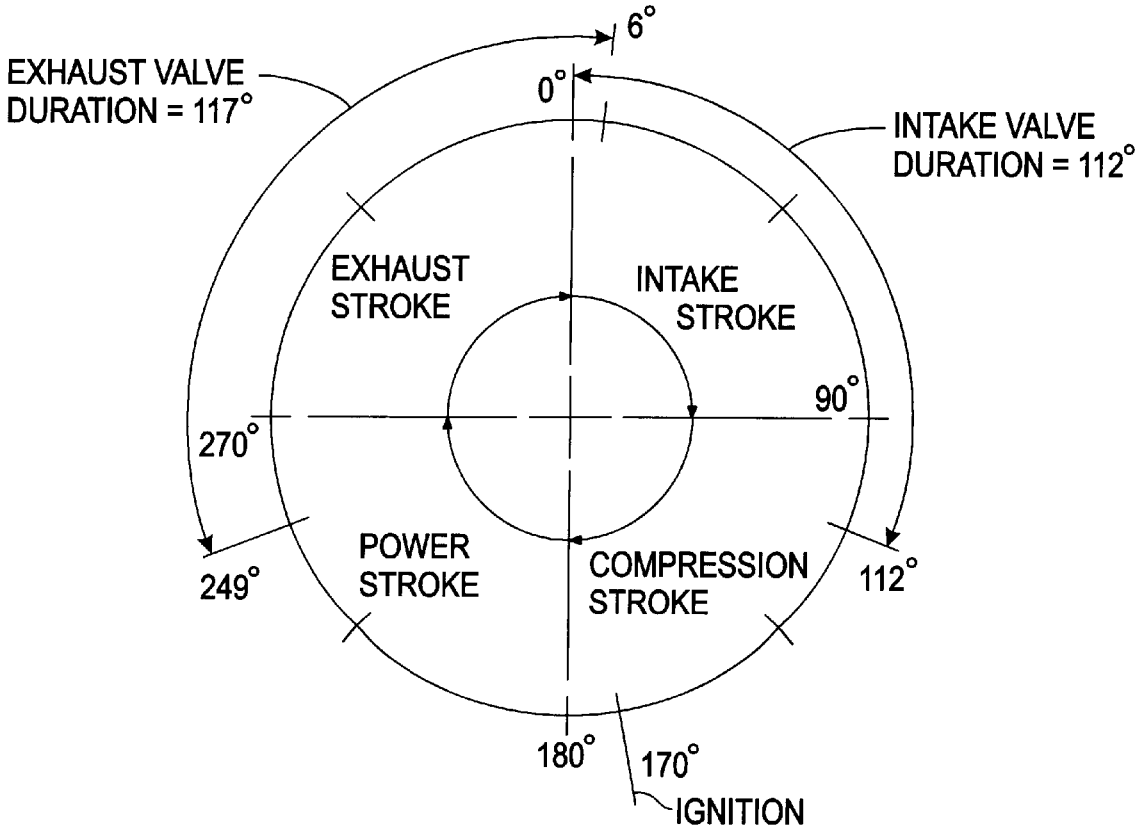
FIG. 16 is a graphic illustration of the four stroke power cycle of the piston corresponding to a 360° rotation of the power shaft, and having the intake and exhaust valve duration, along with the ignition timing, superimposed thereon.

Throughout this description of the four stroke cycle, the position of the various components of the engine will be described with reference to the progress of the power shaft 12 through a single revolution. This is graphically illustrated in FIG. 16. In FIG. 16, a circle 102 represents one 360° revolution of the power shaft 12. That revolution is assumed to begin at the top most point on the circle which has been designated as 0°. The power shaft 12 is assumed to be rotating clockwise as seen in FIG. 16. The first clockwise quadrant from 0° to 90° corresponds to the downward intake stroke of piston 14. The second clockwise quadrant from 90° to 180° corresponds to the upward compression stroke of piston 14. The third clockwise quadrant from 180° to 270° corresponds to the downward power stroke of the piston 14, and the fourth quadrant from 270° to 360° (that is back to 0°) corresponds to the upward exhaust stroke of the piston 14.

The intake valve duration, that is the time during which the intake valve 84 is open as determined by the design of intake cam 80 and its associated valve train, extends from 0° to 112°. The exhaust value duration, similarly, extends from 249° to 6°. The timing of the ignition of spark plug 90 is preferably set at 170°.

With reference to FIG. 16, and to FIGS. 3, 5, 7 and 9, the motion of the engine is as follows.

Beginning with the piston 14 in its top dead center position as shown in FIG. 3 at the beginning of the intake stroke, the piston 14 moves downward from the position of FIG. 3 to the position of FIG. 5 to complete the intake stroke which corresponds to the 90° position on circle 102 in FIG. 16. Thus, the power shaft 12 has rotated clockwise through an angle of 90° between the positions of FIGS. 3 and 5. During this intake stroke of piston 14, the piston 14 is not actually driving the power shaft 12, but rather the power shaft 12 is being rotated by the momentum of the attached flywheel (not shown) and the other rotating components of the drive train.

Throughout the downward intake stroke of piston 14 from FIG. 3 to FIG. 5 as just described, the intake valve 84 is open to allow a fuel and air mixture to flow into combustion chamber 92 in a conventional fashion.

Figure 7:
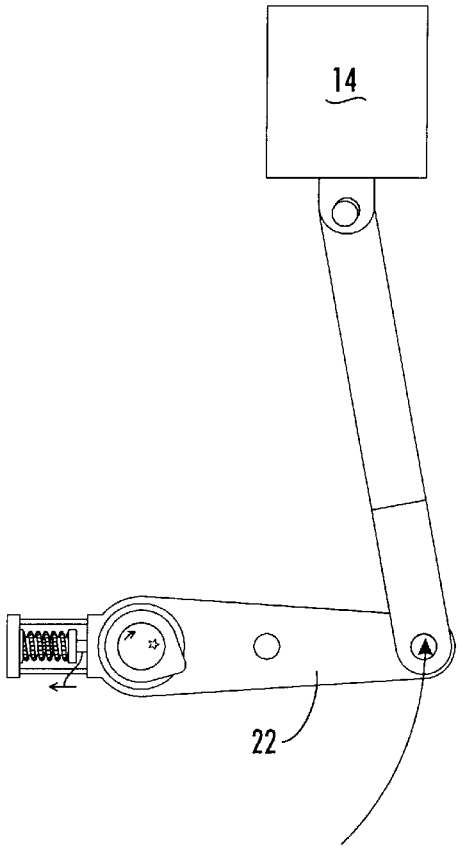
FIG. 7 is a schematic view similar to FIG. 3 showing the piston having moved back upwards midway through its compression stroke.
Figure 9:
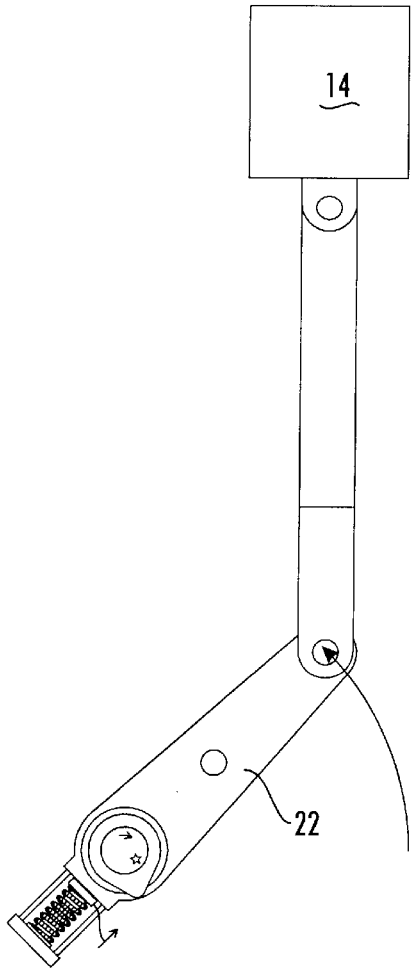
FIG. 9 is a view similar to FIG. 3 showing the piston having returned to a top dead center position at the end of its compression stroke. The power shaft has rotated through 180° from FIG. 3 to FIG. 9.

Once the piston 14 reaches its bottom dead center position as shown in FIG. 5, the power shaft 12 will continue to rotate in a clockwise direction, whereas the motion of auxiliary crank shaft 40 will cause the power crank 22 to begin moving back upward thus carrying the piston 14 back upward in a compression stroke. This upward motion of power crank 22 and piston 14 is illustrated in FIGS. 5, 7 and 9. FIG. 5 is the bottom dead center position. In FIG. 7 the power crank 22 and piston 14 have moved upward approximately halfway through the compression stroke. In FIG. 9 the power crank 22 has again reached its upwardmost position corresponding to the top dead center position of piston 14 which completes the compression stroke. The position of FIG. 9 corresponds to the 180° on the circle 102 in FIG. 6.

As noted by the intake valve duration schematically represented on FIG. 16, the intake valve 84 closed at the 112° position and has remained closed during the remainder of the compression stroke so that the piston 14 compresses the fuel air mixture in the compression chamber 92.

The spark plug 90 was fired at the 170° position just prior to the end of the compression stroke. Now, the burning and expanding fuel air mixture in the compression chamber 92 will force the piston 14 back downward from the position of FIG. 9 again to a bottom dead center position corresponding to that of FIG. 5. The power shaft 12 will be rotated to its 270° position as the piston 14 moves through its downward power stroke.

In the initial position of FIG. 3, the power crank 22 is located at 45° to the vertical and in the final position of FIG. 5 the power crank 22 is located at 135° to the vertical, so that as the piston 14 moves through a downward stroke the maximum possible leverage is provided to the power crank 22 from the piston 14. This gives the maximum mechanical advantage so as to increase the torque output of the engine.

Then, the piston 14 will again reverse direction and will move upward through its exhaust stroke thus completing the cycle.

The exhaust valve duration preferably extends from the 249° position to the 6° position as schematically illustrated on FIG. 16.

During the intake stroke as the piston 14 moves from the position of FIG. 3 to the position of FIG. 5, the locking pin 66 remains in engagement with the abutment surface 72 of the first locking recess 58 as illustrated in FIGS. 4 and 6. As the piston 14 moves upward through its compression stroke between the positions of FIGS. 5 and 9, the locking pin 66 will be cammed radially outward out of engagement with the locking recess 58 as shown in FIG. 8, thus allowing the power shaft 12 to continue to rotate. When the piston 14 reaches its top dead center position of FIGS. 9 and 10, the locking pin 66 will again move into engagement with the other recessed surface 60. Then, as the power piston 14 moves downward through its power stroke, that power will be transferred through the lever arm of the power crank 22 through the locking pins 66 to the abutment surface 76 and thus to the power shaft 12 so that the power shaft 12 will be rotated through an angle of 90° by the piston 14 as the piston 14 moves downward through its power stroke. Then, as the piston 14 again moves upward through its exhaust stroke, the locking pin 66 will once again be cammed radially outward out of engagement with the second recessed surface 60 and at the end of the exhaust stroke, the locking pin 66 will once again be received in the first locking recess 58 in exactly the position illustrated in FIG. 4, thus completing the cycle.

It is believed that my new internal combustion engine and combination power collector apparatus just described provides a number of improvements as compared to conventional internal combustion engines.

The power shaft and cam shaft of a conventional engine have been combined, thus eliminating the separate cam shaft of a conventional engine and the many parts related thereto.

It is noted that the piston 14 transfers force to the power crank 22 along a much straighter line of force than with a conventional engine having the piston connected to a conventional crank shaft. It is believed that this will result in longer life of the piston, ring and cylinder bore, less scoring on the pistons and sleeves and longer engine life in general. It is also believed that the flywheel, power shaft and bearings will have a longer life due to a more vibration-free rotation. Also, there will be higher engine efficiency resulting from a straighter line of force application from the piston to the power crank.

It is believed that this arrangement will provide more torque at lower RPM. This will be very advantageous for certain types of equipment such as land moving equipment, over the road trucks and the like. These vehicles working at lower RPM will put out less pollution and achieve better fuel mileage.

It is also believed that the present arrangement will provide less weight in power transmission parts from the piston to the flywheel, and that those same components will be cheaper to produce thus resulting in a more economically manufactured engine.

It is also believed that the engine of the present invention will provide safer operation due to being able to produce sufficient torque at a lower RPM.

Thus it is seen that the apparatus of the present invention readily achieves the ends and advantages mentioned, as well as those inherit therein. While certain preferred embodiments of the invention have been illustrated and described for purposes of the present disclosure, numerous changes in the arrangement and construction of parts may be made by those skilled in the art, which changes are encompassed within the scope and spirit of the present invention as defined by the appended claims.

What is claimed is:

1. An internal combustion engine, comprising:

a power shaft;

at least one piston and cylinder assembly; and a power transfer mechanism connecting the piston to the power shaft so that for each two reciprocations of the piston, within the cylinder, the power shaft makes only one 360° rotation, wherein the power transfer mechanism includes:

a power crank having an outer end portion and an inner end portion;

a connecting rod having a first end connected to the piston and a second end connected to the outer end portion of the power crank; and a ratchet connecting the inner end portion of the power crank to the power shaft.

2. The engine of claim 1, wherein:

the piston and cylinder assembly is constructed to perform a four stroke combustion cycle including intake stroke, compression stroke, power stroke and exhaust stroke for each two reciprocations of the piston within the cylinder.

3. The engine of claim 1, wherein the power transfer mechanism further comprises:

an auxiliary crank shaft;

a two-to-one ratio drive train connecting the auxiliary crank shaft to the power shaft so that the auxiliary crank shaft rotates at twice the rotational speed of the power shaft;

an eccentric crank attached to the auxiliary crank shaft; and an auxiliary connecting rod having a first end connected to the eccentric crank and having a second end attached to the power crank so that the power crank is moved through two reciprocating cycles for each rotation of the power shaft.

4. The engine of claim 1, wherein the ratchet comprises:

a cylindrical outer surface defined on the power shaft concentric about an axis of rotation of the power shaft, the cylindrical outer surface having two locking recesses defined therein on diametrically opposite sides of the cylindrical outer surface;

the power crank having a cylindrical bore defined therethrough, within which the cylindrical outer surface of the power shaft is received;

the power crank having a locking pin bore defined transversely therethrough and communicated with the cylindrical bore;

a locking pin reciprocally received in the locking pin bore;

a locking spring biasing the locking pin inward toward the locking recesses of the cylindrical outer surface of the power shaft; and wherein each locking recess is shaped so that when the locking pin is engaged with the locking recess a power stroke of the piston and power crank can be transferred to the power shaft through the locking pin, and so that the power shaft can continue to rotate freely within the power crank after the power stroke.

5. The engine of claim 1, further comprising:

cam means, defined on the power shaft, for actuating intake and exhaust valves associated with the piston and cylinder assembly.

6. An internal combustion engine, comprising:

a power shaft;

a power crank;

a ratchet connecting the power crank to the power shaft;

a piston;

a connecting rod connected at one end to the piston and at another end to the power crank;

an auxiliary crank shaft;

a two-to-one drive train connecting the auxiliary crank shaft to the power shaft so that the auxiliary crank shaft rotates at twice the rotational speed of the power shaft; and an auxiliary connecting rod connecting the auxiliary crank shaft to the power crank so that the power crank is moved through one reciprocating cycle for each rotation of the auxiliary crank shaft.

7. The engine of claim 6, further comprising:

an intake cam attached to the power shaft; and an exhaust cam attached to the power shaft.

8. The engine of claim 7, wherein:

the intake cam and exhaust cam are adjustably attached to the power shaft so that intake and exhaust timing of the engine may be adjusted.

9. The engine of claim 6, further comprising:

an ignition timing ring adjustably attached to the power shaft.

10. An internal combustion engine, comprising:

a power shaft having a power shaft locking surface concentrically defined thereon;

a power shaft throw having a bore therethrough which the power shaft locking surface is received;

a piston and cylinder assembly;

a piston connecting rod connecting the piston to the power shaft throw; and a spring biased lock pin assembly, attached to the power shaft throw, and operably associated with the power shaft locking surface, so that the lock pin assembly alternately locks and unlocks from the power shaft surface to convert a reciprocating arcuate motion of the power shaft throw into a rotational motion of the power shaft.

11. The engine of claim 10, further comprising:

a crank shaft;

a two-to-one ratio drive train connecting the power shaft to the crank shaft, so that the crank shaft rotates at twice the rotational speed of the power shaft; and an auxiliary rod connecting the crank shaft to an intermediate point of the power shaft throw between the power shaft and the piston connecting rod.

12. The engine of claim 10, further comprising:

an intake cam mounted on the power shaft.

13. The engine of claim 12, wherein:

the intake cam is adjustably mounted on the power shaft.

14. The engine of claim 10, further comprising:

an exhaust cam mounted on the power shaft.

15. The engine of claim 14, wherein:

the exhaust cam is adjustably mounted on the power shaft.

16. The engine of claim 10, further comprising:

an ignition timing ring mounted on the power shaft.

17. The engine of claim 16, wherein:

the ignition timing ring is adjustably mounted on the power shaft.

18. The engine of claim 10, wherein:

the power shaft locking surface has two diametrically opposed locking recesses defined therein.

19. The engine of claim 18, wherein:

each of the locking recesses includes a sloped portion which allows relative rotation between the power shaft and the power shaft throw in a first direction, and each of the locking recesses includes an abutment surface which stops relative rotation between the power shaft and the power shaft throw in a second direction opposite the first direction.

20. An internal combustion engine, comprising:

a power shaft;

at least one piston and cylinder assembly;

a power transfer mechanism connecting the piston to the power shaft so that for each two reciprocations of the piston, within the cylinder, the power shaft makes only one 360° rotation; and cam means, defined on the power shaft, for actuating intake and exhaust valves associated with the piston and cylinder assembly.

* * * * *